US010006660B2

(12) United States Patent
Ojiro

(10) Patent No.: US 10,006,660 B2
(45) Date of Patent: Jun. 26, 2018

(54) HEAT SOURCE APPARATUS

(71) Applicant: RINNAI CORPORATION, Nagoya-shi, Aichi (JP)

(72) Inventor: Takashi Ojiro, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 0 days. days.

(21) Appl. No.: 15/598,453

(22) Filed: May 18, 2017

(65) Prior Publication Data

US 2017/0350618 A1 Dec. 7, 2017

(30) Foreign Application Priority Data

Jun. 2, 2016 (JP) ..... 2016-110881
Jun. 20, 2016 (JP) ..... 2016-121553

(51) Int. Cl.

| | |
|---|---|
| ***F24H 1/40*** | (2006.01) |
| ***F24H 1/14*** | (2006.01) |
| ***F24H 1/06*** | (2006.01) |
| ***F24H 9/02*** | (2006.01) |
| ***F24H 9/20*** | (2006.01) |

(52) U.S. Cl.

CPC ..... *F24H 1/145* (2013.01); *F24H 1/06* (2013.01); *F24H 9/02* (2013.01); *F24H 9/2035* (2013.01)

(58) Field of Classification Search

CPC ... F24H 1/145; F24H 1/40; F24H 1/06; F24H 8/00; F22B 29/061; F22B 15/00; F22B 37/20

See application file for complete search history.

(56) References Cited

U.S. PATENT DOCUMENTS 2,632,435 A * 3/1953 Lundstrum ..... F24C 3/004 126/116 B
6,224,370 B1 * 5/2001 Tomizawa ..... F23C 13/00 165/166
6,237,586 B1 * 5/2001 Fontes ..... F24H 1/0081 122/13.01
9,814,645 B2 * 11/2017 Sang ..... A61G 9/00

(Continued)

FOREIGN PATENT DOCUMENTS

EP 2811141 A1 12/2014
JP 3-030056 U 3/1991

*Primary Examiner* — Gregory A Wilson
(74) *Attorney, Agent, or Firm* — Cermak Nakajima & McGowan LLP; Tomoko Nakajima

(57) ABSTRACT

In a heat source apparatus in which an electric component having an electrode and an insulator is mounted on a side plate of a combustion box, in a state in which a packing is interposed between a flange portion of the insulator and the side plate, by fastening a clamp which overlaps with an outer surface of the flange portion, to the side plate, the temperature rise in the clamp is restrained.

Upper and lower water tubes constituting a part of a water jacket are disposed on the side plate on upper and lower sides of the position of mounting the electrode component. In case the upper and lower water tubes are disposed on an inside surface of the side plate, the upper and lower parts of the clamp are brought into contact with those disposed positions of the water tubes which are in upper and lower portions of the side plate and, in case the upper and lower water tubes are disposed on an outside of the side plate, the upper and lower parts of the clamp are brought into contact with the upper and lower water tubes.

2 Claims, 6 Drawing Sheets

(56) References Cited

U.S. PATENT DOCUMENTS

| | | | | |
|---|---|---|---|---|
| 2015/0369495 | A1* | 12/2015 | Maricic | F23D 14/045<br>126/116 A |
| 2016/0377282 | A1* | 12/2016 | Sugioka | F23D 14/02<br>431/353 |
| 2018/0087805 | A1* | 3/2018 | Ooshita | F24H 1/124 |

* cited by examiner

HEAT SOURCE APPARATUS

BACKGROUND OF THE INVENTION

1. Technical Field

The present invention relates to a heat source apparatus which is provided with: a burner; a combustion box for enclosing a combustion space for air-fuel mixture ejected from a combustion surface of the burner; and a heat exchanger, disposed in the combustion box, for heating cold water.

2. Background Art

As this kind of heat source apparatus, there is known one having mounted an electrode component in that portion of a side plate on one side of the combustion box which lies between the burner and the heat exchanger. The electrode component comprises: an electrode which protrudes into the combustion box through a through-hole formed in the one-side side plate; and an insulator through which the electrode is fixedly inserted (see, e.g., patent document, JP-UM-H3-30056). In this specification, the "side plate on one side" is also referred to as "one-side side plate" for brevity. In this arrangement, the insulator has a flange portion which overlaps with a portion of outside surface around the through-hole in the one-side side plate. In a state in which a packing is interposed between the flange portion and the one-side side plate, a clamp (or a retainer) which overlaps with an outside surface of the flange portion is fastened to the one-side side plate, whereby the electrode component is mounted in position on the one-side side plate.

In the above-mentioned prior art, the clamp rises in temperature due to heat transmission through the insulator. In a heat source apparatus in which the rated combustion amount of the burner is made higher, the clamp will rise to a considerably high temperature. Then, a harness including a lead wire that is connected to the electrode component may come into contact with the clamp, thereby sometimes causing damages by the heat of the harness. In this case, in order to restrain the heat transmission from the insulator to the clamp, it may be considered to interpose a second packing between the flange portion of the insulator and the clamp. This will, however, give rise to an increase in cost.

Further, as a heat source apparatus, there is known one, in EP-A-2811141, in which a water jacket is disposed in that portion of the combustion box which lies between the burner and the heat exchanger, the water jacket being connected to the heat exchanger in order to cool the combustion box. Part of the water jacket is constituted by water tubes to be disposed on a side plate of the combustion box.

SUMMARY

Problems that the Invention is to Solve

This invention has a problem of providing a heat source apparatus in which an increase in temperature in the clamp can be restrained by taking advantage of those water tubes for the water jacket which are disposed on the side plate of the combustion box.

Means for Solving the Problems

In order to solve the above problem, this invention has an advantage of providing a heat source apparatus comprising:

a burner; a combustion box for enclosing a combustion space for air-fuel mixture ejected from a combustion surface of the burner; a heat exchanger, disposed in the combustion box, for heating cold water; a water jacket disposed in that portion of the combustion box which lies between the burner and the heat exchanger, the water jacket being connected to the heat exchanger in order to cool the combustion box. An electrode component is mounted in that portion of a one-side side plate of the combustion box which lies between the burner and the heat exchanger, the electrode component comprising: an electrode which protrudes into the combustion box through a through-hole formed in the one-side side plate; and an insulator through which the electrode is fixedly inserted. The insulator has a flange portion which overlaps with a portion of outside surface around the through-hole in the one-side side plate and, in a state in which a packing is interposed between the flange portion and the one-side side plate, a clamp which overlaps with an outside surface of the flange portion is fastened to the one-side side plate, whereby the electrode component is mounted in position on the one-side side plate. In the above-mentioned heat source apparatus, the water tubes constituting a part of the water jacket are disposed on the one-side side plate in the neighborhood of the position of mounting the electrode component. In case the water tubes are disposed on an inside surface of the one-side side plate, a part of the clamp is in contact with that disposing portion of the water tubes which is on the one-side side plate and, in case the water tubes are disposed on an outside surface of the one-side side plate, a part of the clamp is in contact with the water tubes.

According to this invention, a part of the clamp comes into contact with the water tubes or the disposed portion of the water tubes. As a result, the clamp is cooled by the water flowing through the water tubes. The rise in temperature of the clamp can thus be restrained. Further, since the second packing need not be interposed between the flange portion of the insulator and the clamp, the cost can thus be prevented from increasing.

Further, according to this invention, the water tubes are disposed on upper and lower sides, respectively, of the position of mounting the electrode component on the one-side side plate, and in case these upper and lower water tubes are disposed on the inside surface of the one-side side plate, preferably the clamp is in contact with that portion of the one-side side plate at which the upper and lower water tubes are disposed and, in case these upper and lower water tubes are disposed on the outside surface of the one-side side plate, the clamp is in contact with the upper and lower water tubes. According to this arrangement, the clamp can be efficiently cooled by the upper and lower water tubes. The temperature rise in the clamp can surely be restricted.

PREFERRED EMBODIMENTS FOR CARRYING OUT THE INVENTION

Figure 1:
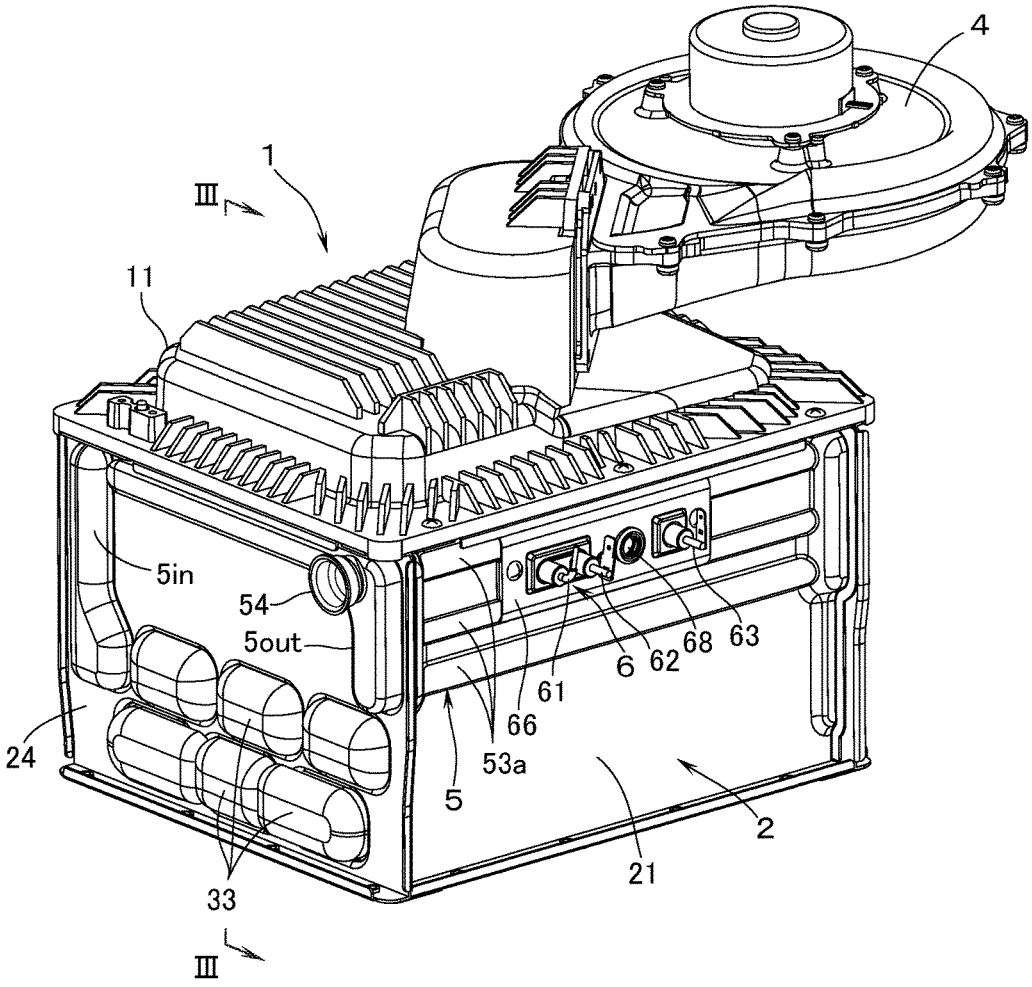
FIG. 1 is a perspective view of a heat source apparatus of an embodiment of this invention.
Figure 2:
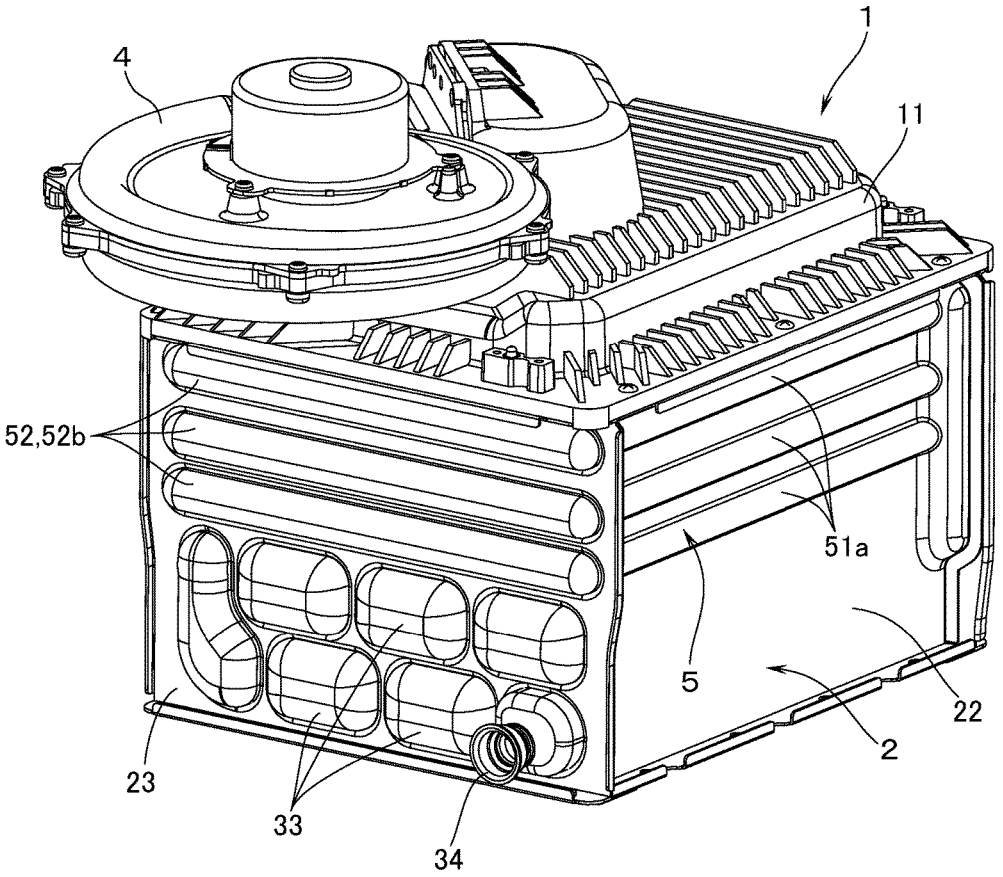
FIG. 2 is a perspective view of the heat source apparatus of the embodiment as viewed from a side opposite to that in FIG. 1.
Figure 3:
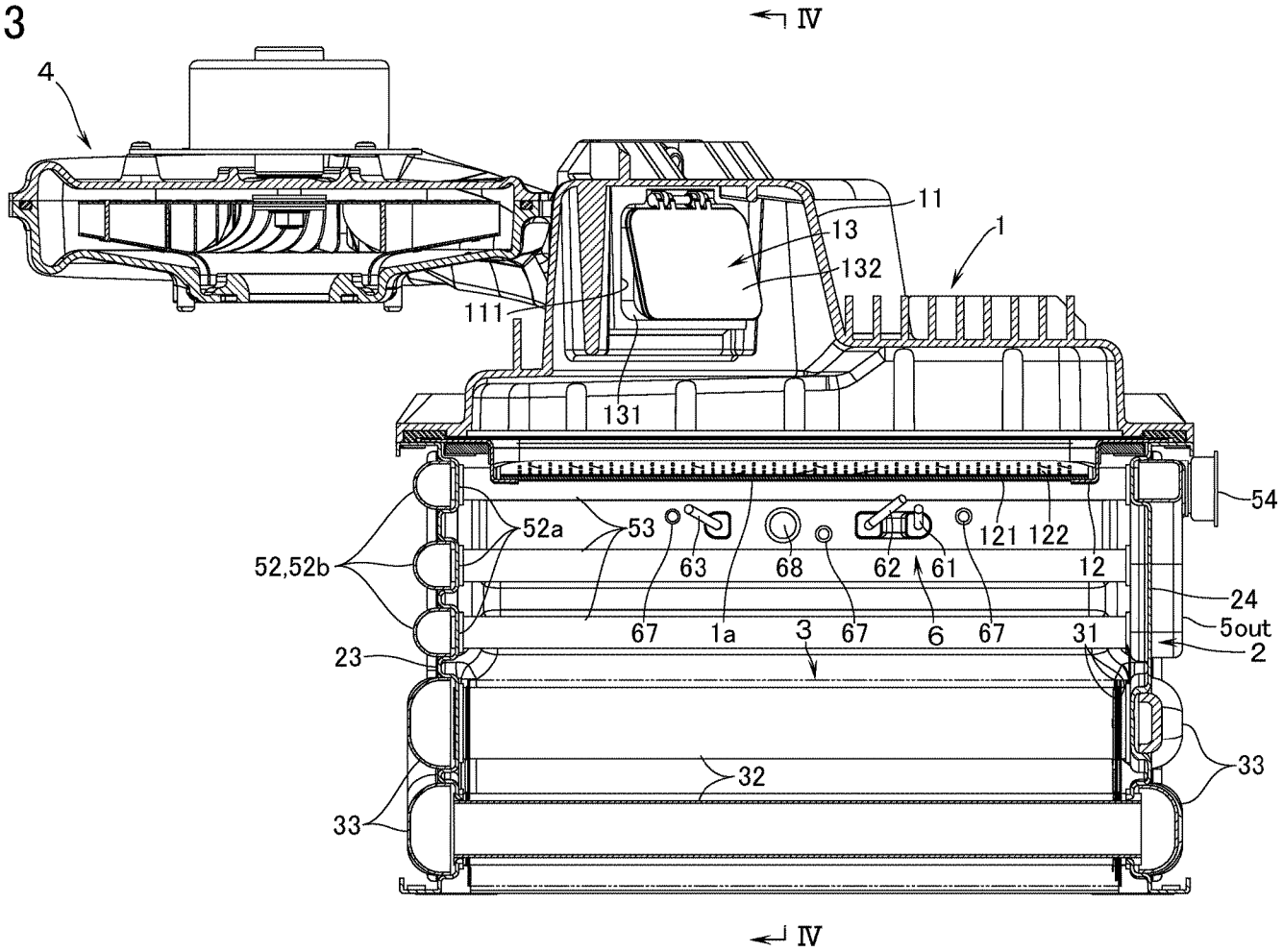
FIG. 3 is a sectional view cut away along the line III-III in FIG. 1.
Figure 4:
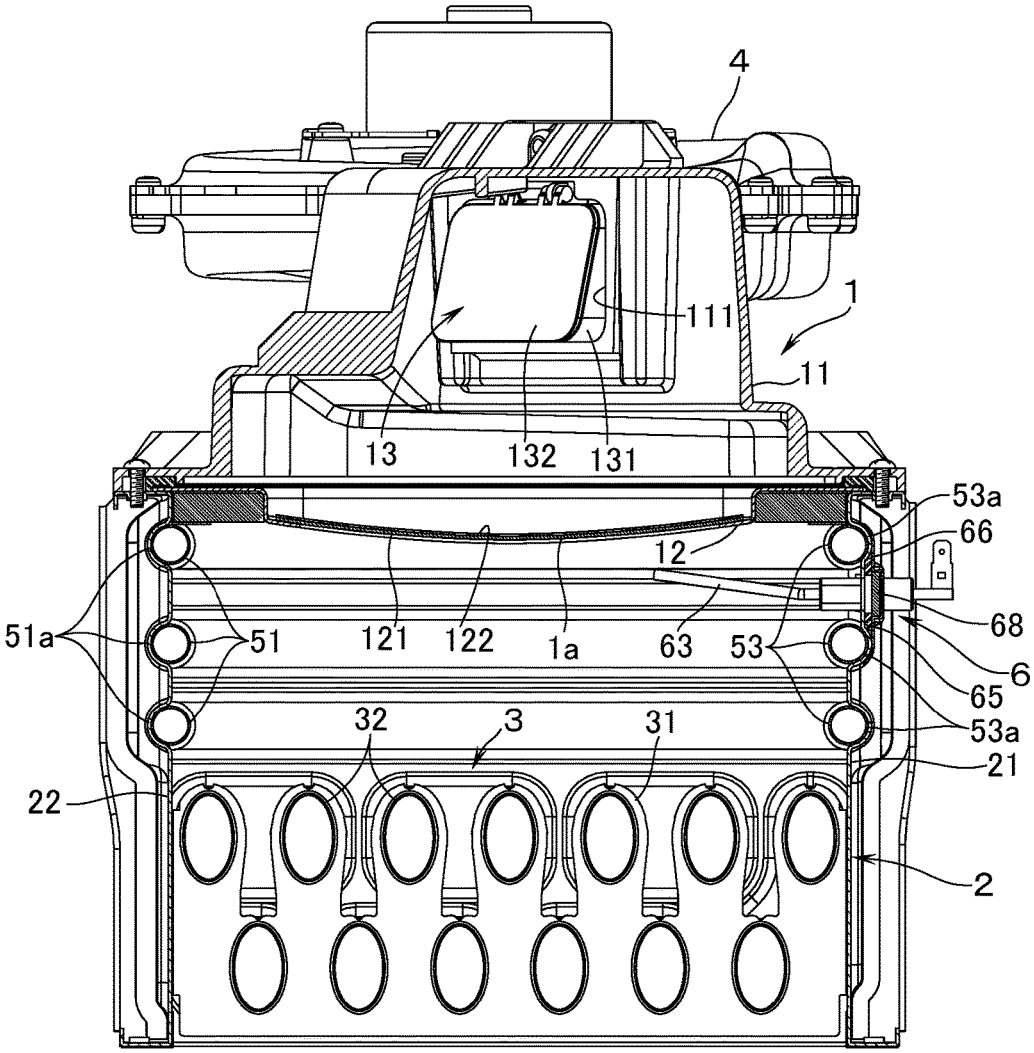
FIG. 4 is a sectional view cut away along the line IV-IV in FIG. 3.

With reference to FIGS. 1 through 4, a heat source apparatus according to the first embodiment of this invention is provided with: a burner 1 of a downward posture with a combustion surface 1*a* facing downward; and a combustion box 2 on a lower side of the burner 1, the combustion box 2 enclosing the combustion space for the air-fuel mixture that is ejected from the combustion surface 1*a*. The combustion box 2 is constituted by: a side plate 21 on the front side; a side plate 22 on the rear side; a side plate 23 on laterally one side; and a side plate 24 on laterally the other (opposite) side. In the lower portion of the combustion box 2 there is housed a heat exchanger 3 which heats the cold water for supplying hot water or for heating.

The burner 1 is constituted by: a burner body 11 whose lower surface is arranged to be an open surface; and a combustion plate 12 which is mounted on the lower surface of the burner body 11 and which constitutes the combustion surface 1*a*. The burner body 11 is provided with an inlet port 111 which is connected to a fan 4 for supplying air-fuel mixture. The inlet port 111 has a check valve 13 which is mounted to prevent the air-fuel mixture remaining inside the burner body 11 from flowing back toward the fan 4 at the time of stopping the fan 4. The check valve 13 is constituted by: a valve box 131 which is fit into the inlet port 111; and a valve plate 132 which is swingably mounted, for opening or closing, on that opening portion of the valve box which is directed toward the burner body 11. Further, the combustion plate 12 has a large opening portion in the central part of the combustion plate 12. This opening portion is covered by a piece of canvass 121 of heat-resistant fibers, and a distribution plate 122 with a multiplicity of distribution holes formed therein is overlapped on an upper surface of the canvass 121. It is thus so arranged that the air-fuel mixture inside the burner body 11 can be ejected through the distribution plate 122 and the canvass 121 for totally primary air combustion.

The heat exchanger 3 is constituted by a fin-tube type of heat exchanger having: a multiplicity of fins 31; and a plurality of heat-absorbing tubes 32 passing through these fins 31. On outside surfaces of laterally one side and laterally the other side of the side plates 23, 24 of the combustion box 2, there are mounted a plurality of connection lids 33 which define, between each of the side plates 23, 24 and the connection lids 33, connection passages for the adjoining two heat-absorbing pipes 32, 32. All of the heat-absorbing tubes 32 are thus connected in series to each other. In addition, in the connection lid 33 which defines, between the side plate 23 on one lateral side and the connection lid 33, the connection passage to be connected to the heat-absorbing tube 32 on the upstream end, there is provided a water inlet 34.

In addition, in that portion of the combustion box 2 which lies between the burner 1 and the heat exchanger 3, there is provided a water jacket 5 which is connected to the downstream side of the heat exchanger 3 in order to cool the combustion box 2. This water jacket 5 is constituted by: first water tubes 51 vertically arranged three pieces disposed on the side plate 22 on the rear side of the combustion box 2 so as to be laterally elongated; third water tubes 53 vertically arranged three pieces disposed on the side plate 21 on the front of the combustion box 2 so as to be laterally elongated; the second water tubes 52 vertically arranged three pieces so as to be elongated longitudinally (back and forth) so as to connect the first and third water tubes 51, 53; an inlet-side header 5in which is disposed near the back of the laterally other side plate 24 of the combustion box 2 so as to introduce the water passed through the heat exchanger 3 into the first water tubes 51; and an outlet-side header 5out into which flows the water from the third water tubes 53. On an upper part of the outlet-side header 5out, there is provided a hot water outlet 54 for connecting the hot water supply passage. According to this arrangement, the water (hot water) passing through the heat exchanger 3 flows from the inlet-side header 5in through the first water tubes 51, the second water tubes 52, and the third water tubes 53 into the outlet-side header 5out, and is supplied from the hot water outlet port 54 to the hot water supply passage.

Each of the first and third water tubes 51, 53 is disposed on the inside surface of each of the side plates 21, 22 on the front and rear sides, respectively, of the combustion box 2. In concrete, on each of the side plates 21, 22 on the front and rear sides, respectively, a swelled-out portion 51*a*, 53*a* swollen outward in a hemispherical shape is formed in a position in which each of the water tubes 51, 53 is mounted. Each of the water tubes 51, 53 is mounted into the respective swelled-out portions 51*a*, 53*a* in a state in which each of the water tubes 51, 53 is placed in position into the respective positions. In addition, the second water tube 52 is constituted by: an indented portion 52*a* which is formed in the side plate 23 in a manner to be dented laterally inward; and a cover 52*b* which covers the dented portion 52*a*.

Figure 5:
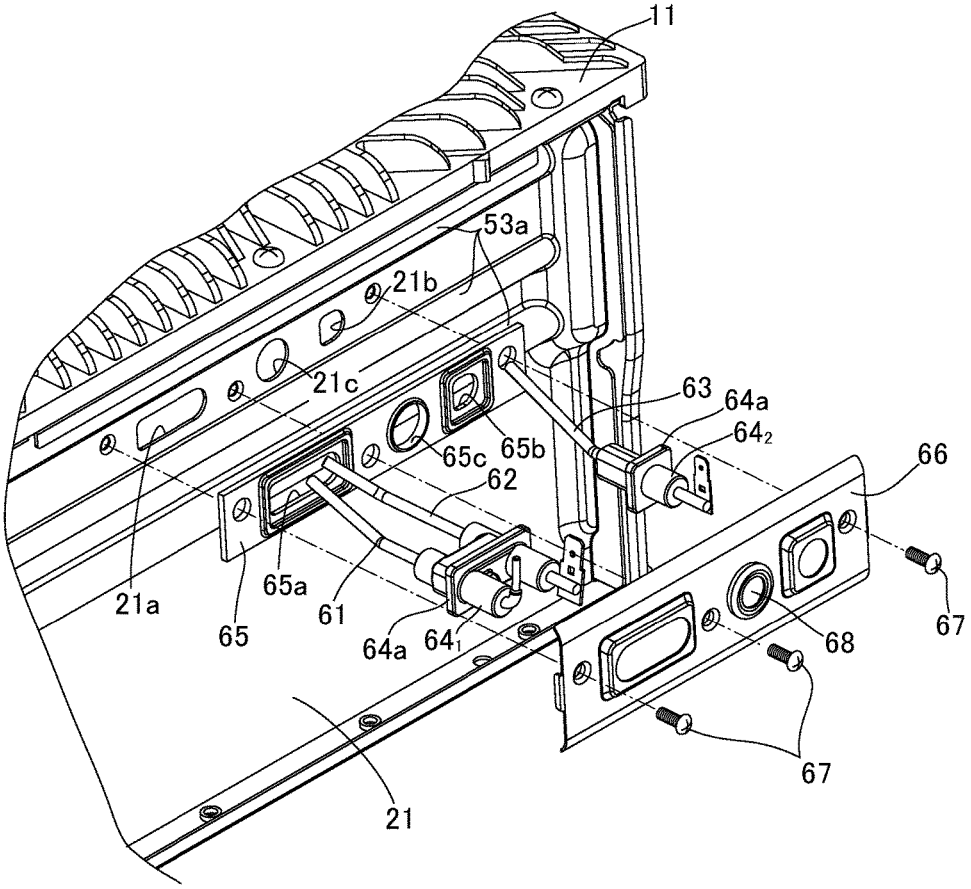
FIG. 5 is an exploded perspective view of an essential portion of the heat source apparatus of the embodiment.

With reference also to FIG. 5, in that portion of the side plate 21 on the front side of the combustion box 2 which lies between the burner 1 and the heat exchanger 3, there is mounted an electrode component 6 made up of: an electrode including an ignition electrode 61, a ground electrode 62, and a flame rod 63; a first insulator $\mathbf{64}_1$ which fixes in position by inserting the ignition electrode 61 and the ground electrode 62; and a second insulator $\mathbf{64}_2$ which fixes in position by inserting the flame rod 63. The ignition electrode 61 and the ground electrode 62 protrude into the combustion box 2 through a laterally elongated through-hole 21*a* formed in the side plate 21. The flame rod 63 protrudes into the combustion box 2 through another through-hole 21*b* formed in the side plate 21. Each of the first and second insulators $\mathbf{64}_1$, $\mathbf{64}_2$ has a flanged portion 64*a* which overlaps with the surrounding portion of each of the through-holes 21*a*, 21*b* in the side plate 21. Then, in a state in which a common laterally elongated packing 65 is interposed between both the first and second flanged portions 64*a*, 64*a* of both the first and second insulators $\mathbf{64}_1$, $\mathbf{64}_2$ and the side plate 21, a common laterally elongated clamp 66 which overlaps with the outside surfaces of the flanged portions 64*a*, 64*a* of the insulators $\mathbf{64}_1$, $\mathbf{64}_2$ are fastened, i.e., fixed with screws 67, to the side plate 21, thereby mounting the electrode component 6 to the side plate 21.

The packing 65 has formed therein a through-hole 65*a* for inserting the ignition electrode 61 and the ground electrode 62, and also a through-hole 65*b* for inserting the flame rod 63. The clamp 66 is further provided with a peep hole (inspection hole) 68 for visually confirming the inside of the combustion box 2. The side plate 21 and the packing 65 have formed therein through-holes 21*c*, 65*c* corresponding to the peep hole 68.

By the way, the clamp 66 rises in temperature as a result of heat transmission through each of the first and second insulators $\mathbf{64}_1$, $\mathbf{64}_2$. Then, in a heat source apparatus with an increased rated burning capacity of the burner 1, the clamp

66 will considerably rise in temperature. The harness (not illustrated) inclusive of a lead wire which is connected to the electrode component 6 comes into contact with the clamp 66, and there is a possibility of damaging the harness due to the heat. In this case, in order to restrain the heat transmission from each of the insulators $\mathbf{64}_1$, $\mathbf{64}_2$ to the clamp 66, it may be considered to interpose a second packing between the flange portion 64*a* of each of the insulators $\mathbf{64}_1$, $\mathbf{64}_2$ and the clamp 66. This solution will result in an increase in cost.

Figure 6:
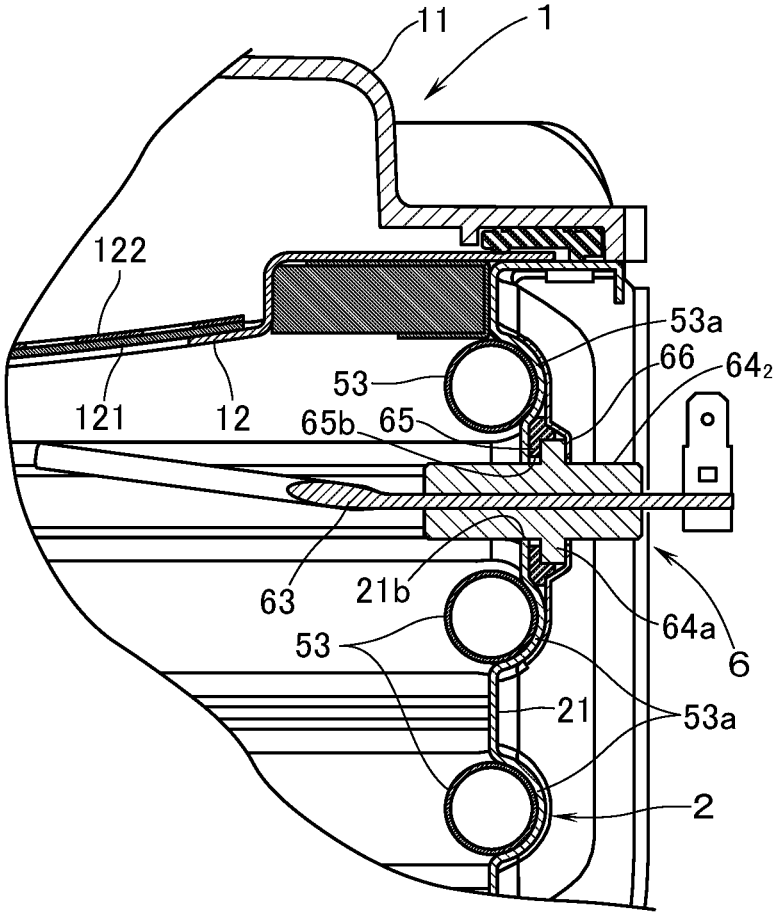
FIG. 6 is an enlarged sectional view of an essential portion of the heat source apparatus of the embodiment.

On an inside surface of the side plate 21, the third water tubes 53 are disposed on upper and lower positions of mounting the electrode component 6. In this embodiment, as shown in FIG. 6, the upper and lower portions of the clamp 66 are bent to follow the upper and lower swelled-out portions 53*a*, 53*a*, i.e., those disposed portions on the upper and lower third water tubes 53, 53 of the mounting portion of the electrode component 6 which are formed in the side plate 21 on the front side. Then, the upper and lower bent portions of the clamp 66 are arranged to come into contact with the upper and lower swelled-out portions 53*a*, 53*a*.

According to this arrangement, the clamp 66 will be cooled by the water that flows through the third water tubes 53 and, therefore, the temperature rise in the clamp 66 can be restrained. It follows that additional second packing is not required to be interposed between the flange portions 64*a* of each of the insulators $\mathbf{64}_1$, $\mathbf{64}_2$ and clamp 66, resulting in no rise in the costs. It is also acceptable to cause the clamp 66 to contact only one of the upper and lower swelled-out portions 53*a*, 53*a*. In this embodiment, however, the clamp 66 can be cooled at both the upper and lower portions thereof. Therefore, the cooling efficiency of the clamp 66 is improved, and the temperature rise in the clamp 6 can surely be advantageously restricted.

Descriptions have so far been made of the embodiments of this invention with reference to the drawings. This invention, however, shall not be limited to the above. For example, in the above-mentioned embodiments, the third water tubes 53 are disposed on the inside surface of the side plate 21 on the front side of the combustion box 2. It is to be noted that the third water tubes 53 may also be disposed on the outside surface of the side plate 21. In this case, at least one of the upper and lower portions of the clamp 66 may be brought into contact with at least one of the upper and lower third water tubes 53, 53 in the mounting portion of the electrode component 6. Further, the side plate on which the electrode component 6 is mounted may alternatively be the side plate 22 on the rear side, or one side plate or the other side plate 23, 24 as seen in the lateral direction. Still furthermore, the water jacket 5 may be connected to the upstream side of the heat exchanger 3.

EXPLANATION OF MARKS

1 burner
1*a* combustion surface
2 combustion box
21 side plate on the front side (side plate on one side, also referred to as "one-side side plate")
21*a*, 21*b* through-hole
3 heat exchanger
5 water jacket
53 third water tubes (upper and lower water tubes)
53*a* swelled-out portion (portion in which water tubes are mounted in position)
6 electrode component
61 ignition electrode (electrode)
62 ground electrode (electrode)
63 flame rod (electrode)
$\mathbf{64}_1$, $\mathbf{64}_2$ insulator
64*a* flange portion
65 packing
66 retainer (clamp)

What is claimed is:

1. A heat source apparatus comprising:

a burner;

a combustion box for enclosing a combustion space for air-fuel mixture ejected from a combustion surface of the burner;

a heat exchanger, disposed in the combustion box, for heating cold water;

a water jacket disposed in that portion of the combustion box which lies between the burner and the heat exchanger, the water jacket being connected to the heat exchanger in order to cool the combustion box;

an electrode component mounted in that portion of a one-side side plate of the combustion box which lies between the burner and the heat exchanger, the electrode component comprising: an electrode which protrudes into the combustion box through a through-hole formed in the one-side side plate; and an insulator through which the electrode is fixedly inserted, the insulator having a flange portion which overlaps with a portion of outside surface around the through-hole in the one-side side plate and, in a state in which a packing is interposed between the flange portion and the one-side side plate, a clamp which overlaps with an outside surface of the flange portion is fastened to the one-side side plate, whereby the electrode component is mounted in position on the one-side side plate, wherein water tubes constituting a part of the water jacket are disposed on the one-side side plate in the neighborhood of position of mounting the electrode component;

wherein, in case the water tubes are disposed on an inside surface of the one-side side plate, a part of the clamp is in contact with that disposed portion of the water tubes which is on the one-side side plate; and in case the water tubes are disposed on an outside surface of the one-side side plate, a part of the clamp is in contact with the water tubes.

2. The heat source apparatus according to claim 1, wherein the water tubes are disposed in upper and lower positions of mounting the electrode component on the one-side side plate;

wherein, in case these upper and lower water tubes are disposed on the inside surface of the one-side side plate, the clamp is in contact with that portion of the one-side side plate at which the upper and lower water tubes are disposed and, in case these upper and lower water tubes are disposed on the outside surface of the one-side side plate, the clamp is in contact with the upper and lower water tubes.

* * * * *